US012203471B2

(12) United States Patent
Meeruang

(10) Patent No.: US 12,203,471 B2
(45) Date of Patent: Jan. 21, 2025

(54) COMPRESSOR HAVING A STEPPED SUCTION PASSAGE

(71) Applicant: SIAM COMPRESSOR INDUSTRY CO., LTD., Chonburi (TH)

(72) Inventor: Jetsada Meeruang, Chonburi (TH)

(73) Assignee: SIAM COMPRESSOR INDUSTRY CO., LTD., Chonburi (TH)

( * ) Notice: Subject to any disclaimer, the term of this patent is extended or adjusted under 35 U.S.C. 154(b) by 0 days.

(21) Appl. No.: 18/730,438

(22) PCT Filed: Mar. 30, 2023

(86) PCT No.: PCT/IB2023/053162

§ 371 (c)(1),
(2) Date: Jul. 19, 2024

(87) PCT Pub. No.: WO2024/201104

PCT Pub. Date: Oct. 3, 2024

(65) Prior Publication Data

US 2024/0418167 A1 Dec. 19, 2024

(51) Int. Cl.
*F04C 18/02* (2006.01)
*F04C 29/12* (2006.01)

(52) U.S. Cl.
CPC ..... *F04C 18/0215* (2013.01); *F04C 2230/10* (2013.01)

(58) Field of Classification Search
CPC ..... F04C 18/0215; F04C 18/0261; F04C 18/0253; F04C 29/12
See application file for complete search history.

(56) References Cited

U.S. PATENT DOCUMENTS

2010/0215535 A1* 8/2010 Kiyokawa ..... F04C 23/008 418/55.1

FOREIGN PATENT DOCUMENTS

| | | | |
|---|---|---|---|
| JP | 2017-053279 | A | 3/2017 |
| WO | 2012/127553 | A1 | 9/2012 |
| WO | 2022/021665 | A1 | 2/2022 |

OTHER PUBLICATIONS

International Search Report of the International Searching Authority issued Oct. 17, 2023 in corresponding International Patent Application No. PCT/IB2023/053162.
Written Opinion of the International Searching Authority issued Oct. 17, 2023 in corresponding International Patent Application No. PCT/IB2023/053162.

* cited by examiner

*Primary Examiner* — Deming Wan
(74) *Attorney, Agent, or Firm* — Posz Law Group, PLC

(57) ABSTRACT

The present invention discloses a compressor comprising: a fixed scroll including a suction communication passage that is formed so that refrigerant flowing through a suction pipe is guided to a compression chamber. The suction communication passage is formed so that the cross-sectional shape of the suction communication passage includes a step-like portion that is formed by multiple steps.

5 Claims, 3 Drawing Sheets

COMPRESSOR HAVING A STEPPED SUCTION PASSAGE

CROSS REFERENCE TO RELATED APPLICATION

This application is a U.S. national stage application of PCT/IB2023/053162 filed on Mar. 30, 2023 the contents of which are incorporated herein by reference.

FIELD OF INVENTION

The present invention relates to a compressor.

BACKGROUND OF THE INVENTION

A compressor is known in which a suction communication passage is provided in a fixed scroll so that refrigerant flowing through a suction pipe is guided to a compression chamber, as disclosed in Japanese Unexamined Patent Application Publication No. 2017-53279A hereinafter called PTL1.

In PTL1, to suppress suction pressure loss in the suction communication passage, an upper portion of the suction communication passage is formed so that the cross-sectional shape of the suction communication passage is flat and slope-shaped in a vertical cross sectional view taken along a plane in the direction of the flow path passing through the suction communication passage.

However, it is difficult to form a flat and slope-shaped suction communication passage in the fixed scroll using conventional processing methods such as an end mill machining method.

Therefore, the development of the compressor, that can suppress the suction pressure loss in the suction communication passage as well as that can easily form the suction communication passage in the fixed scroll, is required.

CITATION LIST

Patent Literature

PTL 1: Japanese Unexamined Patent Application Publication No. 2017-53279A

SUMMARY OF THE INVENTION

It is an objective of the present inventions to provide a compressor that can suppress the suction pressure loss in the suction communication passage as well as that can easily form the suction communication passage in the fixed scroll.

In order to achieve the above objective, an embodiment of the present invention provides a compressor comprising: a sealed container; a motor element housed in the sealed container; a scroll compression element housed in the sealed container and configured to be driven by a crankshaft of the motor element; a suction pipe mounted penetratingly the sealed container, in which gas refrigerant sucked from outside flows into the scroll compression element, and wherein the scroll compression element including a fixed scroll including a first scroll body and an orbiting scroll including a second scroll body configured to be engaged with the first scroll body to form a compression chamber between the first scroll body and the second scroll body, the orbiting scroll being configured to orbit opposed to the fixed scroll, wherein the fixed scroll includes a suction communication passage that is formed so that refrigerant flowing through the suction pipe is guided to the compression chamber, and wherein the suction communication passage is formed so that the cross-sectional shape of the suction communication passage includes a step-like portion that is formed by multiple steps in a vertical cross-sectional view taken along a plane in the direction of the flow path passing through the suction communication passage.

Firstly, according to the embodiment of the present invention, the cross-sectional shape of the suction communication passage includes the step-like portion that is formed by multiple steps in a vertical cross sectional view taken along a plane in the direction of the flow path passing through the suction communication passage.

As such, the suction pressure loss can be suppressed by suppressing a sudden change in the flow path of the refrigerant in the suction communication passage.

Secondly, since the cross-sectional shape of the suction communication passage includes the step-like portion that is formed by multiple steps, the suction communication passage including the step-like portion can be formed more easily compared to form a flat, slope-shaped suction communication passage.

Therefore, according to the embodiment of the compressor of the present invention, it is possible to suppress the suction pressure loss in the suction communication passage as well as to easily form the suction communication passage in the fixed scroll.

BRIEF DESCRIPTION OF DRAWINGS

The principle of the present invention and its advantages will become apparent in the following description taking into consideration with the accompanying drawings in which.

DETAILED DESCRIPTION OF EMBODIMENTS OF THE INVENTION

Hereinafter, an embodiment of the present invention will be described in detail with reference to the drawings.

Figure 1:
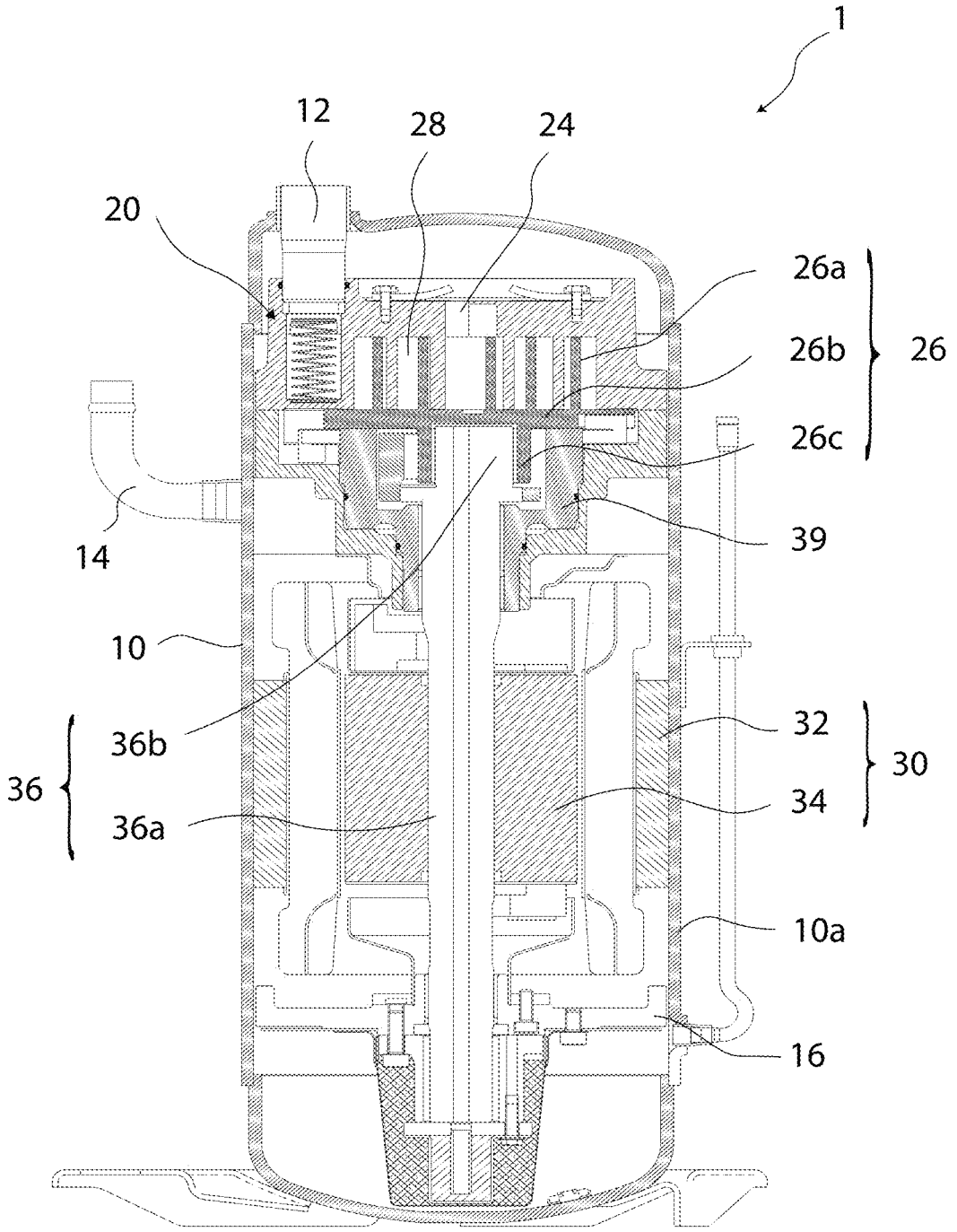
FIG. 1 is an explanation view illustrating a schematic configuration according to an embodiment of the present invention of a compressor 1.

FIG. 1 is an explanation view illustrating a schematic configuration of a scroll compressor 1 according to the embodiment. The scroll compressor 1 is a fluid machine configured to compress and discharge a fluid (i.e., gas refrigerant), and can be a component of a refrigeration cycle apparatus. The scroll compressor 1 according to the embodiment is a vertically-mounted shell compressor.

As shown in FIG. 1, the scroll compressor 1 includes a sealed container 10, a suction pipe 12 mounted penetratingly a top face of the sealed container 10 and formed as a hollow cylindrical pipe, a discharge pipe 14 discharging the gas refrigerant to the outside, a scroll compression element 20 configured to compress a low-pressure gas refrigerant in a compression chamber 28, and a motor element 30 configured to drive the scroll compression element 20 which is housed in the sealed container 10.

The upper portion of the compression element 20 is supported by a middle shell 10*a* of the sealed container 10. The compression element 20 is fixed to the middle shell 10*a* of the sealed container 10 through shrink fit or other methods. A sub-frame 16 is provided below the motor element 30. The sub-frame 16 is fixed to the inner circumferential surface of the sealed container 10.

The suction pipe 12 configured to suck a low-pressure gas refrigerant into the compression element 20 from outside is connected to a side surface of the sealed container 10. The discharge pipe 14 configured to discharge a high-pressure gas refrigerant to the outside of the scroll compressor 1 is connected to the side face of the sealed container 10.

The compression element 20 is accommodated in the sealed container 10 and configured to compress the refrigerant sucked from the suction pipe 12 through rotation of a crankshaft 36 that is driven by the motor element 30. As shown in FIG. 1, the compression element 20 includes a fixed scroll 22 and an orbiting scroll 26.

Figure 2A:
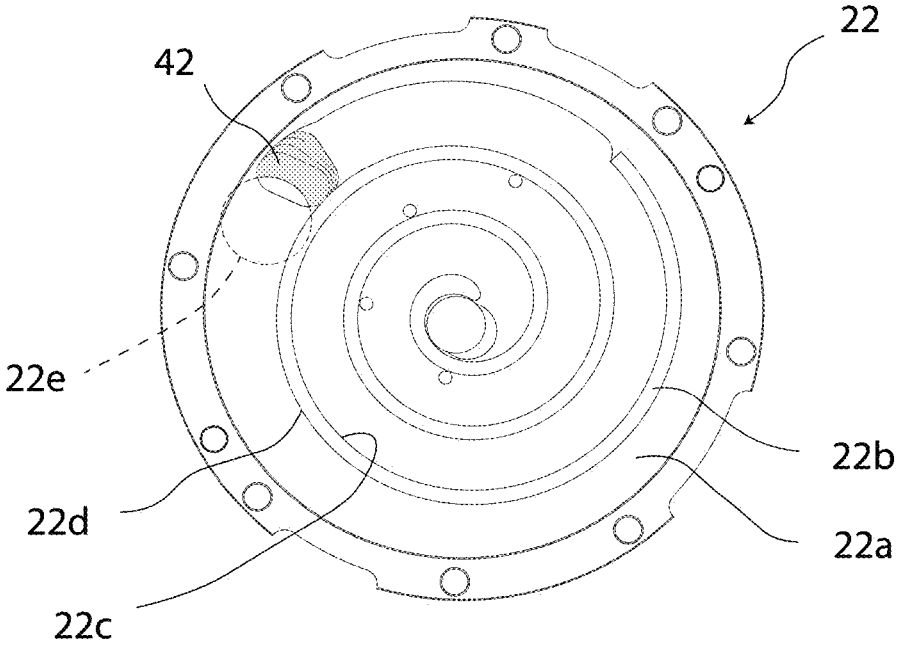
FIG. 2A is an explanation view of a fixed scroll 22 of FIG. 1.

As shown in FIG. 1 and FIG. 2A, the fixed scroll 22 is fixed to the middle shell 10*a* at a lower end portion of the fixed scroll 22. The fixed scroll 22 includes a fixed scroll base plate 22*a* and a fixed scroll spiral wrap 22*b* having an involute curve shape so as to form a spiral body and erected on one surface of the fixed scroll base plate 22*a*. A discharge port 24 configured to discharge a compressed refrigerant is formed in a central part of the fixed scroll 22.

Moreover, the fixed scroll 22 includes a suction communication passage 40 that is formed so that the refrigerant flowing through the suction pipe 12 is guided to the compression chamber 28.

Figure 4:
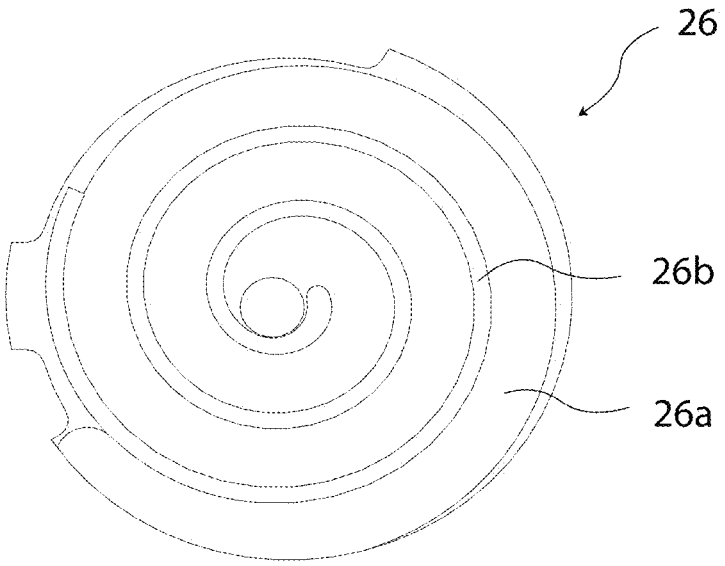
FIG. 4 is an explanation view of an orbiting scroll 26 of FIG. 1.

As shown in FIG. 1 and FIG. 4, the orbiting scroll 26 is configured to orbit opposed to the fixed scroll 22 without rotating, by a non-illustrated Oldham mechanism. The orbiting scroll 26 includes an orbiting scroll base plate 26*a* and an orbiting scroll spiral wrap 26*b* having an involute curve shape so as to form a spiral body and erected on one surface of the orbiting scroll base plate 26*a*. An orbiting bearing 26*c* formed in a bottomed cylindrical shape is formed in a substantially central part on an undersurface of the orbiting scroll base plate 26*a*. An eccentric shaft portion 36*b* installed on an upper end of a main shaft portion 36*a* described later is inserted in the orbiting bearing 26*c*, in order to cause the orbiting scroll 26 to orbit.

The orbiting scroll spiral wrap 26*b* is configured to be engaged with the fixed scroll spiral wrap 22*b* to form the compression chamber 28 between the fixed scroll spiral wrap 22*b* and the orbiting scroll spiral wrap 26*b*. The orbiting scroll 26 is configured to orbit opposed to the fixed scroll 22.

The motor element 30 includes an electric motor stator 32 fixed to the inner circumferential surface of the sealed container 10 through shrink fit or other methods, an electric motor rotor 34 rotatably housed on an inner circumferential side of the electric motor stator 32, and the crankshaft 36 (main shaft portion 36*a*) fixed to the electric motor rotor 34 through shrink fit or other methods. The electric motor rotor 34 is configured to rotate as electric power is supplied to the electric motor stator 32 and transmit a driving force to the orbiting scroll 26 through the crankshaft 36.

The eccentric shaft portion 36*b* located above the electric motor rotor 34 in the crankshaft 36 is rotatably supported in a radial direction by the cylindrical orbiting bearing 26*c* installed under the orbiting scroll base plate 26*a*. The main shaft portion 36*a* is fitted in a main bearing 39 and slides along the main bearing 39 by an oil film of lubricating oil. The eccentric shaft portion 36*b* eccentric to the main shaft portion 36*a* is installed on the upper end of the crankshaft 36.

Next, the suction communication passage 40 formed in the foxed scroll is described in detail with reference to FIG. 2A to FIG. 2B and FIG. 3.

Figure 2B:
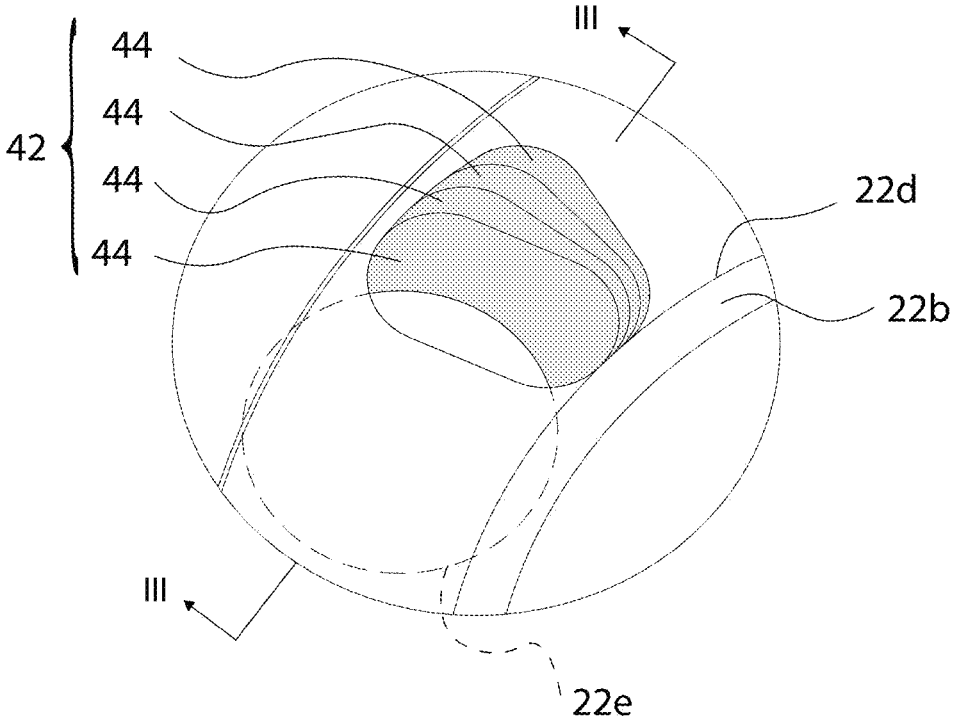
FIG. 2B is an enlarged view of a step-like portion 42 of a suction communication passage 40 of FIG. 2A.
Figure 3:
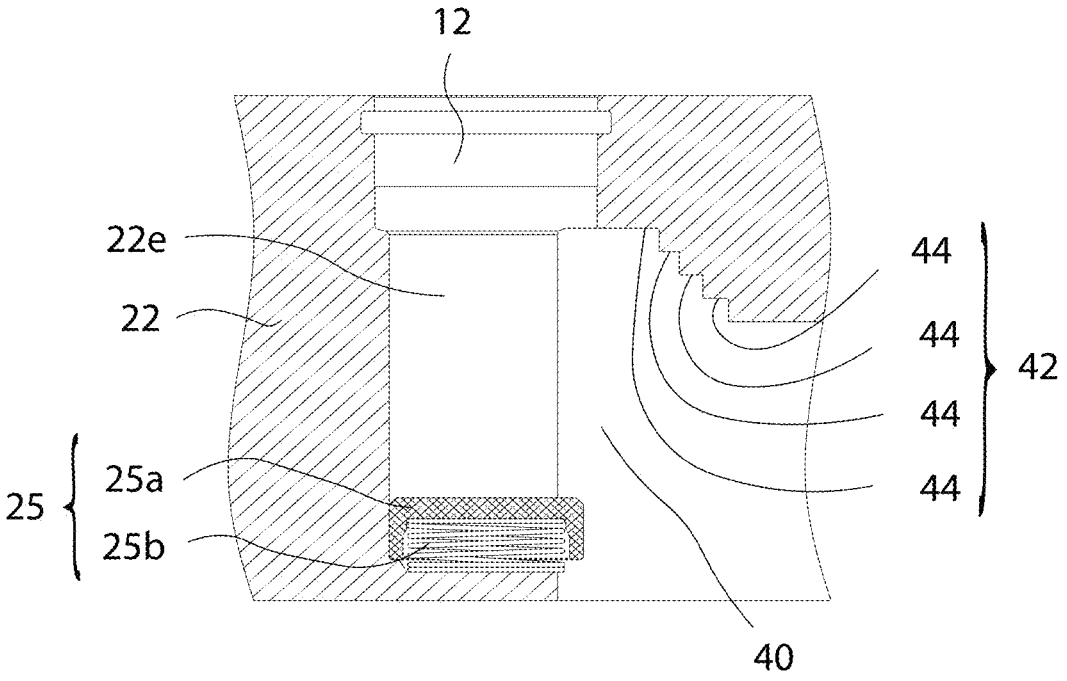
FIG. 3 is a cross sectional view taken along line III-III of FIG. 2B.

As shown in FIG. 2A to FIG. 2B and FIG. 3, the suction communication passage 40 is formed so that the refrigerant flowing through the suction pipe 12 is guided to the compression chamber 28. A suction hole 22*e* is formed in the upper portion of the fixed scroll 22 (See FIG. 3). In FIG. 2A and FIG. 2B, the circumference of the suction hole 22*e* is shown as a circle drawn with the dashed line in order to show the positional relationship between the suction hole 22*e* and the suction communication path.

The suction pipe 12 is fitted in the suction hole 22*e*. The suction hole 22*e* is provided with a check valve 25 for preventing reverse flow of the refrigerant. The check valve 25 includes a valve body 25*a* and a spring 25*b* that urges the valve body 25*a* toward the side of the suction pipe 12. The refrigerant flowing through the suction pipe 12 is led to the compression chamber 28 via the suction hole and the suction communication passage 40.

As shown in FIG. 3 that is the longitudinal cross sectional view taken along a plane in the direction of flow path of the refrigerant flowing through the suction communication passage 40, the suction communication passage 40 is formed so that the cross-sectional shape of the suction communication passage 40 includes a step-like portion 42 that is formed by multiple steps 44 in a vertical cross sectional view taken along a plane in the direction of the flow path passing through the suction communication passage 40. The step-like portion 42 is colored by light gray in FIG. 2A and FIG. 2B.

As shown in FIG. 2B, when viewed from a side where the fixed scroll 22 is engaged with the orbiting scroll 26, the step-like portion 42 is formed so that the cross-sectional shape of the suction communication passage 40 becomes lower for each step 44 and so that with respect to the center of the fixed scroll 22, the length of a curve on which an outermost point of each step 44 is located is longer than the length of a curve on which an innermost point of each step 44 is located along an outer wall 22*d* of the fixed scroll 22.

As such, the innermost point of each step 44 is located along the involute curve of the outer wall 22*d* of the fixed scroll 22. By forming each step 44 in the same shape, when viewed from a side where the fixed scroll 22 is engaged with the orbiting scroll 26, the area surrounded by the outermost points and the inner points of the steps 44 and is formed almost sectorially.

As such, the suction pressure loss can be suppressed by suppressing a sudden change in the flow path of the refrigerant in the suction communication passage 40. Therefore, it is possible to reduce the loss that occurs during the process of sucking the gas refrigerant through the suction communication passage 40.

Moreover, since the cross-sectional shape of the suction communication passage 40 includes the step-like portion 42 that is formed by multiple steps 44, the suction communication passage 40 including the step-like portion 42 can be formed more easily by using conventional processing methods such as an end mill machining method, compared to form a flat, slope-shaped suction communication passage 40.

Next, the method for manufacturing the suction communication passage 40 of the scroll compressor 1.

Firstly, the fixed scroll 22 formed with the fixed scroll base plate 22*a* and the fixed scroll spiral wrap 22*b* is prepared. And then, to process the fixed scroll 22 using the end mill machining method, the fixed scroll 22 is fixed to a predetermined fixture.

Next, the multiple steps 44 for the suction communication passage 40 of the fixed scroll 22 are cut from a side where the fixed scroll 22 is engaged with the orbiting scroll 26. During the period when the end mill machining method was applied to the fixed scroll 22, the step-like portion 42 of the suction communication passage 40 is formed by cutting the suction communication passage 40 for each step 44. Therefore, the suction communication passage 40 including the step-like portion 42 can be formed more easily by using conventional processing methods such as an end mill machining method, compared to form a flat, slope-shaped suction communication passage 40.

In particular, the suction communication passage 40 is cut for each step 44 from a lower step to a higher step in order, from the side where the fixed scroll 22 and orbiting scroll 26 are engaged. Therefore, the moving distance of the end mill can be shortened, and thereby the manufacturing time can be shortened.

Although specific embodiments of the invention have been disclosed and described as well as illustrated in the companying drawings, it is simply for the purpose of better understanding of the principle of the present invention and it is not as a limitation of the scope and spirit of the teaching of the present invention. Adaption and modification to various structures such as design or material of the invention, mounting mechanism of various parts and elements or embodiments are possible and apparent to a skilled person without departing from the scope of the present invention which is to be determined by the claims.

LIST OF REFERENCES

1: scroll compressor
10: sealed container
10*a*: middle shell
12: suction pipe
14: discharge pipe
16: sub-frame
20: compression element
22: fixed scroll
22*a*: fixed scroll base plate
22*b*: fixed scroll spiral wrap
22*c*: inner wall
22*d*: outer wall
22*e*: suction hole
24: discharge port
25: check valve
25*a*: valve body
25*b*: spring
26: orbiting scroll
26*a*: orbiting scroll base plate
26*b*: orbiting scroll spiral wrap
26*c*: orbiting bearing
28: compression chamber
30: motor element
32: electric motor stator
34: electric motor rotor
36: crankshaft
36*a*: main shaft portion
36*b*: eccentric shaft portion
39: main bearing
40: suction communication passage
42: step-like portion
44: step

The invention claimed is:

1. A compressor comprising:
a sealed container;
a motor element housed in the sealed container;
a scroll compression element housed in the sealed container and configured to be driven by crankshaft of the motor element;
a suction pipe mounted penetratingly the sealed container, in which a gas refrigerant sucked from outside flows into the scroll compression element, and
wherein the scroll compression element including a fixed scroll including a fixed scroll spiral wrap and an orbiting scroll including an orbiting scroll spiral wrap configured to be engaged with the fixed scroll spiral wrap to form a compression chamber between the fixed scroll spiral wrap and the orbiting scroll spiral wrap, the orbiting scroll being configured to orbit opposed to the fixed scroll,
wherein the fixed scroll includes a suction communication passage that is formed so that the refrigerant flowing through the suction pipe is guided to the compression chamber,
wherein the suction communication passage is formed so that the cross-sectional shape of the suction communication passage includes a step-like portion that is formed by multiple steps in a vertical cross-sectional view taken along a plane in the direction of the flow path passing through the suction communication passage, and
wherein when viewed from a side where the fixed scroll is engaged with the orbiting scroll, the step-like portion is formed so that the cross-sectional shape of the suction communication passage becomes lower with each of the steps and so that with respect to the center of the fixed scroll, a length of a curve on which an outermost point of each of the steps is located is longer than a length of a curve on which an innermost point of each of the steps is located.

2. The compressor of claim 1, wherein the step-like portion is formed so that the step-like portion is in a step shape along the outer wall of the fixed scroll spiral wrap.

3. A method for manufacturing the compressor of claim 1:
cutting the multiple steps for the suction communication passage of the fixed scroll from a side where the fixed scroll is engaged with the orbiting scroll,
wherein the step-like portion of the suction communication passage is formed by cutting the suction communication passage for each of the steps.

4. The method of claim 3, wherein the suction communication passage is cut for each of the steps from a lower step to a higher step in order, from the side where the fixed scroll and orbiting scroll are engaged.

5. The method of claim 3, wherein the step-like portion of the suction communication passage is formed by an end mill machining method.

* * * * *